United States Patent [19]

Giusti

[11] 4,221,318

[45] Sep. 9, 1980

[54] DEVICE FOR DAMPENING THE FORCE EXERTED ON A STRIP MATERIAL DURING ENTRAINMENT

[76] Inventor: Giampiero Giusti, 52, Via Barbantini, 55100 Lucca, Italy

[21] Appl. No.: 9,089

[22] Filed: Feb. 2, 1979

[30] Foreign Application Priority Data

Oct. 9, 1978 [IT] Italy ..... 9609 A/78

[51] Int. Cl.[3] ..... B65H 23/08

[52] U.S. Cl. ..... 226/195

[58] Field of Search ..... 226/95, 195, 18, 19, 226/23; 242/183, 186, 189

[56] References Cited

U.S. PATENT DOCUMENTS

| | | | |
|---|---|---|---|
| 3,525,480 | 8/1970 | Willard | 242/183 |
| 3,560,304 | 2/1971 | Saunders | 226/95 X |

*Primary Examiner*—Leonard D. Christian

*Attorney, Agent, or Firm*—Cushman, Darby & Cushman

[57] ABSTRACT

Apparatus for automatically dampening a strip moving longitudinally in its own plane as a result of a variable pulling force applied to the strip comprising: a strip deflector for engaging a surface of the moving strip and deflecting the strip; a guide for guiding the deflector in a path extending at an angle to the plane of the moving strip; a dampening device for biasing the deflector in a first direction to engage and push against the moving strip and form permitting movement of the deflector in an opposite direction when the strip pushes against the deflector as a result of rapid and violent increase in the pulling force on the strip, the dampening device including a pneumatic cylinder having a piston forming first and second chambers within the cylinder, a piston rod connected to the piston and extending through one end of the cylinder, the piston rod being connected to the deflector so as to bias the latter in said first direction and so that movement of the deflector in said opposite direction by the moving strip moves said rod and piston in a manner to decrease the volume of said first chamber, said dampening device further including a valve responsive to a decreased volume of said first chamber for maintaining a fixed pressure in each of said cylinder chambers with the pressure in said second chamber being less than the pressure in said first chamber whereby said piston exerts a constant biasing force which is transmitted by said rod and deflector to the strip.

3 Claims, 1 Drawing Figure

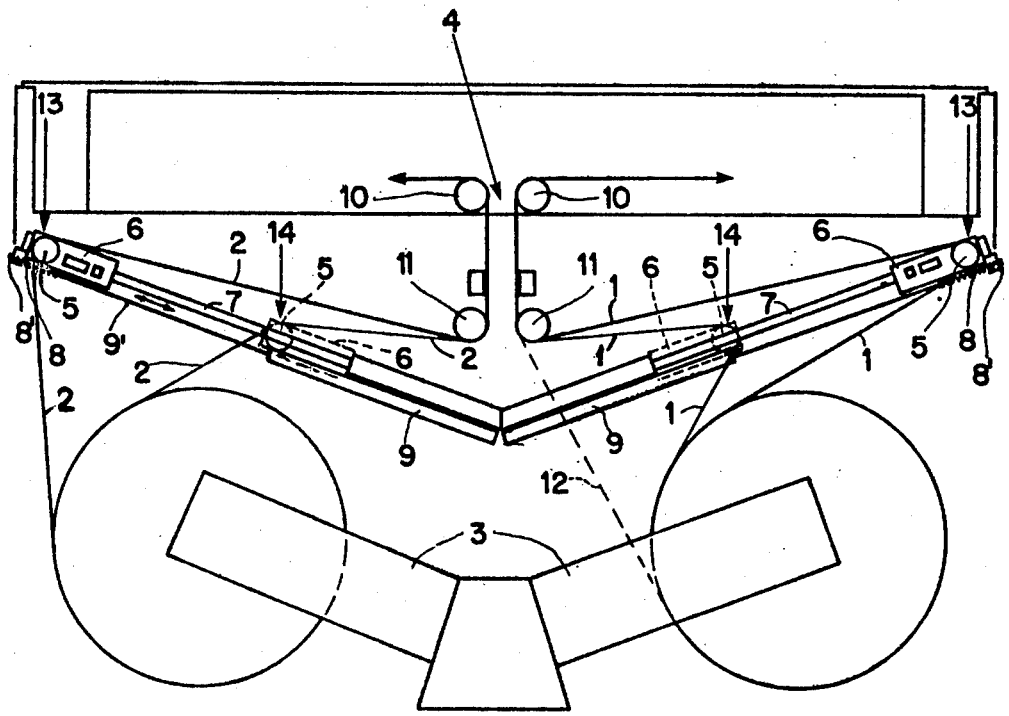
4
13
13
10
10
6
2
14
5
11
11
1
6
5
14
6
5
7
7
8'
8
9'
2
6
2
1'
1
5
8
8'
2
1
9
9
12
3

DEVICE FOR DAMPENING THE FORCE EXERTED ON A STRIP MATERIAL DURING ENTRAINMENT

The present invention relates to a device apt to dampen and compensate automatically the pulling force exerted on the material of a strip subject to breakage, which undergoes a high acceleration during its entrainment.

It is known that, for example, each time that one begins the unwinding of a strip from a stopped reel, to the pulling force exerted on said strip by an opposite machine a notable inertia is opposed by the mass of the reel. In these conditions the material of the strip is subjected to excessive tensile stresses which may easily exceed the limit value of resistance of said material, causing tears or breaks.

Such inconvenience gains in particular notable importance every time that there must be effected, by means of an automatic splicing machine, an operation of substitution of a strip, in which a tear has occurred and which is being unwound from a reel, with a second strip which, in a stopped position and already prepared for this purpose, is spliced to the previous strip which is at the same time cut.

In these cases, if one does not suitably slow the speed of advancement of the strip, with obvious reduction of the overall production efficiency, there would be produced, with extreme ease, especially in conditions of high speeds of advancement of the strip (fed continuously to a production line), tensions or tensile stresses such as to exceed the breaking point of said material, thus causing the tearing of the strip with the consequent interruption of all the production line.

The object of the present invention is to provide a device apt to dampen and compensate said combined effect on the strip of the pulling force and of the resisting force so that the tensions which are produced on the material of the highly accelerated strip are reduced within bearable values, that is, lower than the breaking point of said material.

The device according to the present invention is applied to a portion of the strip between the starting point of the entrained strip (such as a reel being unwound on a reel-holder) and the point at which there is exerted the pulling action (such as by an apposite machine or a driving roller) and is characterized by the fact that it substantially comprises:

(a) deflecting means for the strip, of the type of idler rollers, sliding on guide means along a suitably established direction; and (b) means having a dampening effect, which are applied to said deflecting means and are are adjustable, so as to exert on the strip a constant counterpush or bias, such as to be always lower than that which would cause the tear break of the strip, and thus permit said deflecting means to slide in said direction, progressively moving backwards, in proportion to the push exerted on them by the highly accelerated strip, from an extreme position, which is stable at a steady speed of moving of the strip, corresponds to the normal deviation of its run, and is apt to carry out a storage or stock of said strip, up to another extreme position, corresponding to a run of the strip which approximates the rectilinear one directed from the starting point of the entrained strip to the point at which the pulling action is effected.

Such progressive dampening action, exerted in the above-mentioned manner, has thus the effect of compensating and taking up the strong push applied to said deviation means by the strip when the strip is highly accelerated and subjected to a rapid and violent pulling action; indeed, in their backing movement, said slidable deviation means "give" all or in part the strip of the above-mentioned storage or stock, permitting thus an adaptation of the strip, upstream of the present device, to the required variation of speed, in a prolonged time, so that there can be taken up the excess of tensile stresses, which would have caused the break by tear of the strip itself.

This automatic device thus greatly reduces the possibility of break of a highly accelerated strip during its travel and, in particular, its function is intensified, when such strip must be spliced automatically to another strip which travels at high speed. Such splicing operation, for example, in a production line for corrugated cardboard, takes place between two strips of paper, one being unwound from a reel and the other stopped in position of splicing; the stopped strip undergoes a strong and rapid tensile stress, at the moment in which the corresponding reel is started. In this case the application of the present device to this latter strip permits to effect said automatic splicing operation even at full and high speed of the strip, without causing breaks or tears of the material of said strip.

This obviously provides the possibility of increasing notably the performance of an automating splicing machine with consequent and evident advantages from the point of view of the overall operative and productive performance in a production line such as that for corrugated cardboard.

To better understand the present invention and to show how the same may be carried out in practice, there will now be given a detailed description of one of its exemplificative embodiments, with particular reference to the appended drawing, in which:

the only FIGURE is a schematic lateral elevational view of a feeding system of a production line, such as that for corrugated cardboard, with the application of the device according to the present invention.

With reference to said FIGURE, the device of the present invention is shown applied on two strips 1 and 2, the reels of which are carried by a reel-holder 3. When one of said two strips unwinds from the relative reel at a certain speed, the other is at a standstill in the splicing position.

In the FIGURE there is shown the application of the present device to two strips 1 and 2 with two different modalities of unwinding from the respective reel.

The material of the two strips 1 and 2 may be paper, fabric, tin or aluminum film, plastic, or other material subject to breakage as a result of pulling action.

The device according to the invention comprises:

(a) an idler roller 5 for the strip 1 or 2, mounted at its two side ends, on shoulders 6 slidable on guides or tracks or other guide means, indicated with 7; and (b) damper means, applied on each of the two sides of roller 5 and comprising, aligned in succession, elastic means, for example a compression spring 8, one end of which abuts against a support 8' fixed on the shoulder 6, and which precedes a fixed pneumatic cylinder device 9, with relative sliding stem 9', against the head of which the other end of the spring 8 abuts.

Said spring means 8 have the function of opposing and compensating the movement of idler roller 5, pushed by the strip during its travel, because of the small oscillations to which it is subjected, in order to assure in said strip a distribution of tensions as uniform as possible, eliminating any concentrations of tensions.

The pneumatic cylinder device 9, calibrated for a value higher than that of the calibration of spring 8, has on the other hand the function (after the almost complete compression of spring 8) of dampening, compensating and thus taking up the possible excess of tensions which may be produced in the material of the strip, causing a likely break or tear of the same, every time that the strip is subjected to high accelerations, performing in particular its function when said strip is subjected to a start from a still condition which involves the start of the relative reel, the notable inertia of which causes a corresponding resisting force which opposes the pulling force produced by one of the upper driving rollers 10 of the automatic splicing machine 4 through the corresponding introduction roller 11.

Said pneumatic cylinder 9 opposes the push which the accelerated strip 1 or 2 transmits to the idler roller 5, exerting on said strip, at the same roller 5, a fixed pressure, adjusted through previous calibration of the device, so that the resulting counterpush or bias is always constant and lower than that which would cause the break by tear of said strip. Once having suitably fixed the direction of travel of the idler roller 5, and therefore the inclination of the guides or tracks 7, which, in the case of strip 1, at the right of the FIGURE, is almost orthogonal to the normal moving direction of the strip (represented with a dash line 12, said idler roller 5 backs progressively, sliding along said direction, in proportion to the push it receives from the highly accelerated strip, from an extreme position (indicated approximately with arrow 13), corresponding to the deviation imposed to the strip during its travel at almost constant speed or at rest, up to a final position 14, corresponding to a run of the strip which approximates the rectilinear run between the point at which the reel begins to unwind and that where there is effected the pulling action. The above deviation has been opportunately provided to realize an accumulation or supply of strip (clearly visible in the FIGURE), so that, in its backing movement, said roller 5 gives all or part of said accumulated strip, thus permitting an adaptation, over a prolonged time, of the strip upstream of the device to the required variation of speed. Such adaptation consequently involves a complete taking up of the excess of tensile stresses, produced in the material of the strip, which would have otherwise caused the break by tear thereof.

In conclusion, the progressive dampening action exerted by said device on the strip in the described manner has the overall effect of compensating and taking up the push received by idler roller 5 from the highly accelerated strip, thus reducing to the minimum the probability of breakage of the same and permitting a continuity of feeding of the strip also at high speeds, with notable advantages from the point of view of productive performance in a production line and in particular in that of corrugated cardboard.

Another important feature of the device according to the invention consists in the fact that it can be "counterbalanced", i.e. internally balanced: once the idler roller 5 has backed as far as the end position 14, the device thus allows the roller to return slowly toward position 13 of accumulation and of normal functioning, the device maintaining a constant push, following and dampening possible variations of tension on the strip. The reel once started may overrun, by inertia, and the roller 5 must then move, sliding along the fixed direction, at a speed automatically adequate to keep the tensions on the strip constant.

Said counter-balancing is carried out by usual valve means which act so that, when the piston of the stem 9' is moved within its cylinder 9 toward the right end of the latter (considering, for example, the left part of the FIGURE), in the chamber at the left of said piston within cylinder 9 there is not produced a vacuum, but that there is constantly maintained therein a fixed pressure (naturally lower than the pressure, as well fixed, maintained in the chamber at the right of the piston within cylinder 9).

The damper device according to the invention presents thus the advantage of a high adaptability and flexibility of operation, since, as said, it is adjustable according to the mechanical characteristics of the material of the strip, by means of an apposite calibration of the pneumatic cylinder device 9, and is counter-balanced.

The device also permits a continuous automatic correction of the oscillations of the strip during its travel and therefore an elimination of the tension concentration in said strip, with a final result of better quality of the obtained product and of lower waste of the same.

Summing up, a notably reduced probability of break of the strip also at considerable speed variations of the same and, in particular, in the case of starts from a still condition at very high speeds, results always in a higher productive performance, higher operative safety, better quality of the final product, lower waste, and lower number of interruptions in the production line.

It is evident that the damper means of the above-described device may consist, in addition to the pneumatic cylinder 9, also of an oleo-dynamic cylinder, or of a spring system or any other adjustable system, apt to cause adjusted and gradual counter-push.

It is obvious that numerous other variations may be made to the illustrated exemplificative embodiment of the present invention, without departing from the spirit of the latter; it is understood that all such variations fall within the scope of the invention itself.

I claim:

1. Apparatus for automatically dampening a strip moving longitudinally in its own plane as a result of a variable pulling force applied to the strip comprising: deflecting means for engaging a surface of the moving strip and deflecting the strip; guide means for guiding said deflecting means in a path extending at an angle to the plane of the moving strip; dampening means for biasing said deflecting means in a first direction in said path to engage and push against the moving strip and for permitting movement of said deflecting means in an opposite direction when the strip pushes against said deflecting means as a result of rapid and violent increase in the pulling force on the strip, said dampening means including a pneumatic cylinder having a piston forming first and second chambers within the cylinder, a piston rod connected to said piston and extending through one end of said cylinder, said piston rod being connected to said deflecting means so as to bias the latter in said first direction and so that movement of said deflecting means in said opposite direction by the moving strip moves said rod and piston in a manner to decrease the volume of said first chamber, said dampening means further including valve means responsive to a decreased volume of said first chamber for maintaining a fixed pressure in each of said cylinder chambers with the pressure in said second chamber being less than the pressure in said first chamber whereby said piston exerts a constant biasing force which is transmitted by said rod and deflecting means to the strip.

2. Apparatus as in claim 1 wherein said strip deflecting means includes an idler roller mounted at its two lateral ends on two shoulders slidable on said guide means.

3. Apparatus as in claim 2 further comprising compression spring dampening means mounted between said deflecting means and said piston rod and acting on said deflecting means in said first direction for equalizing continuously and automatically the tensions on the strip, during the normal advancing of the strip.

* * * * *